US005237379A

United States Patent [19]

Sklut et al.

[11] Patent Number: 5,237,379

[45] Date of Patent: Aug. 17, 1993

[54] AUTOMATIC PAPER SIZE SELECTION

[75] Inventors: Robert L. Sklut; John W. Daughton, both of Rochester; Craig Lippolis, Webster, all of N.Y.

[73] Assignee: Xerox Corporation, Stamford, Conn.

[21] Appl. No.: 830,152

[22] Filed: Feb. 3, 1992

[51] Int. Cl.[5] ..... G03G 21/00

[52] U.S. Cl. ..... 355/311; 355/243

[58] Field of Search ..... 355/308, 309, 311, 230, 355/231, 75, 203, 208, 243

[56] References Cited

U.S. PATENT DOCUMENTS

| | | | |
|---|---|---|---|
| 4,190,246 | 2/1980 | Sasuga | 271/145 |
| 4,406,537 | 9/1983 | Mori | 355/311 |
| 4,530,494 | 7/1985 | Saitoh et al. | 271/9 |
| 4,575,227 | 3/1986 | Ito et al. | 355/311 |
| 4,647,188 | 3/1987 | Komiya et al. | 355/243 X |
| 4,796,056 | 1/1989 | Ito | 355/311 X |
| 4,804,997 | 2/1989 | Mizude et al. | 355/311 |
| 4,809,050 | 2/1989 | Ito | 355/311 X |
| 4,908,672 | 3/1990 | Ito | 355/311 |
| 5,031,116 | 7/1991 | Shukunami et al. | 355/311 X |
| 5,072,259 | 12/1991 | Ikeda | 355/311 X |

*Primary Examiner*—A. T. Grimley
*Assistant Examiner*—Nestor R. Ramirez
*Attorney, Agent, or Firm*—Ronald F. Chapuran

[57] ABSTRACT

A method of automatically selecting a desired copy sheet size including sensing the size of a document, and sensing a parameter in nonvolatile memory representing a set of standard copy sheet sizes and a set of non standard copy sheet sizes a selected magnification ratio, determining the preferred copy sheet size in response to the sensed document size, parameters in memory and the magnification selected, and automatically selecting the appropriate copy sheet storage receptacle including the determination of acceptable image to copy sheet ratio. The determination of acceptable image to copy sheet ratio includes the step of determining the ratio of image space to non-image space on the copy sheet and the amount of potential image loss on the copy sheet.

8 Claims, 13 Drawing Sheets

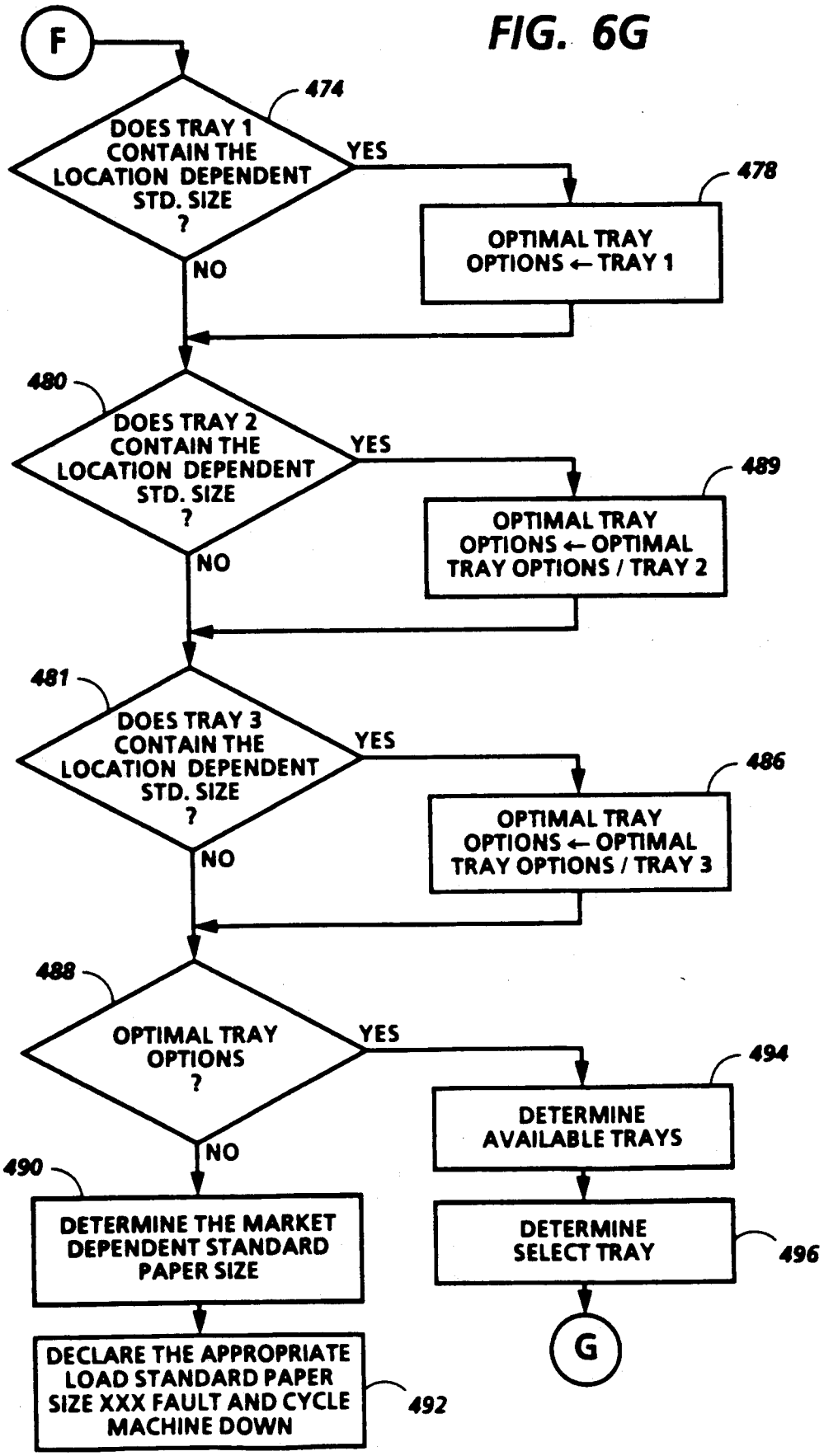
FIG. 6G
F
474
DOES TRAY 1 CONTAIN THE LOCATION DEPENDENT STD. SIZE ?
YES
NO
478
OPTIMAL TRAY OPTIONS ← TRAY 1
480
DOES TRAY 2 CONTAIN THE LOCATION DEPENDENT STD. SIZE ?
YES
NO
489
OPTIMAL TRAY OPTIONS ← OPTIMAL TRAY OPTIONS / TRAY 2
481
DOES TRAY 3 CONTAIN THE LOCATION DEPENDENT STD. SIZE ?
YES
NO
486
OPTIMAL TRAY OPTIONS ← OPTIMAL TRAY OPTIONS / TRAY 3
488
OPTIMAL TRAY OPTIONS ?
YES
NO
494
DETERMINE AVAILABLE TRAYS
DETERMINE SELECT TRAY
496
G
490
DETERMINE THE MARKET DEPENDENT STANDARD PAPER SIZE
DECLARE THE APPROPRIATE LOAD STANDARD PAPER SIZE XXX FAULT AND CYCLE MACHINE DOWN
492

AUTOMATIC PAPER SIZE SELECTION

The invention relates to the control of a reproduction machine, and, more particularly, to a technique for automatic paper size selection.

Automatic programming facilities, such as automatic paper size selection are an important operator feature on most copier-duplicator products.

The Fuji Xerox 7790 possessed a rudimentary automatic paper selection APS capability, which would allow the machine to select a paper size from a limited list of typical sizes based primarily upon the customer original document size. Although this function had limited utility in a particular market place, its implementation was very inconsistent in its handling of magnification ratio and its net effects on resultant on-paper image size. The implementation also provided only a limited list of suitable paper sizes available for automatic selection, and was very inconsistent in error handling or size requirements beyond which was already loaded into the paper trays. Essentially, this functional implementation resembled how an "APS" system is constructed on most low volume copiers, being useful primarily only for jobs which employ only "size for size" copy mode.

It would be desirable, therefore, to provide a true multinational machine that is field configurable to specific regional copy sheet standard sizes to be able to efficiently project images onto the appropriate size copy sheets.

It is an object of the present invention, therefore, to be able to specify a complete and robust list of the most common paper sizes associated with a specified market region, allow the full (64–155%) magnification range available, and to ensure that no substantial image loss would be incurred through the use of this feature, all the while maximizing the productivity of this feature. Another object of the present invention is to insure that only the nearest, most appropriate standard paper size be automatically selected, and that an effective tolerance band be placed around the calculated image size and measured document size.

Another difficulty in the prior art is that of being able to freely mix both metric and English letter sizes at magnification ratios other than size-for-size. It is still another object of the present invention, therefore, to allow simplified automatic field configuration of the most typical paper sizes associated with a particular market which would prevent atypical and unexpected combinations from occurring (e.g.: a "letter" size document in the USA market region, after undergoing a reduction, requesting the operator to load "B5" paper, which is not typical in this market and should be replaced with the nearest standard paper size for USA, namely 8×10-inch).

Also, in accordance with the present inventor, once the list of typical market region sizes was determined, it was discovered that this list, while accurate and appropriate for a universal APS system, could prove too restrictive and cumbersome for typical walk-up use. Typical walk up use is a machine loaded with three of the most typical paper sizes used within the region. To overcome this limitation, it would be desirable to provide a programmable option to specify a different subset of all standard paper sizes employed within that region. In this way, greater tolerance would be given in determining the most appropriate nearest standard paper size, preventing machine shutdowns where the machine requests the loading of a paper size which, though typical within the region, is not typically used at this installation.

For any copy run resulting in duplex copies from originals placed either manually or semiautomatically by the operator (i.e.: situations where originals of various sizes may be used within a single copy run) it is still another object of the present invention to provide the operator with a warning message informing the operator about the potential (or actual) image loss if a particular "side 2" is larger than the corresponding "side 1" copy paper previously selected. This is due to the fact that a particular "side 2" image is committed to use the corresponding "side 1" copy paper (now located within the machine's duplex tray) rather than having free reign over paper size selections.

It is another object of the present invention to specify a universal "press on regardless" APS function, which would allow maximum machine productivity using the APS function regardless of currently loaded paper sizes, so long as the customer would accept copies on larger paper than what was absolutely required or acceptable image loss and that such paper was currently available in the machine (i.e.: minimize shutdows to request loading of specific paper sizes).

It is another object of the present invention to be able to define an extended target set of paper sizes and a limited subset of standard paper sizes in order to define a machine as a "metric" proportional machine or a non metric North American proportional machine.

Further advantages of the present invention will become apparent as the following description proceeds and the features characterizing the invention will be pointed out in the claims annexed to and forming part of this specification.

SUMMARY OF THE INVENTION

Briefly, the present invention is a method of automatically selecting a desired copy sheet size, including sensing the size of a document, sensing a flag in memory representing optional standard sheet sizes, and sensing selected magnification ratio, determining the preferred copy sheet size in response to the sensed document size, flag in memory and the magnification selected, examining a parameter in nonvolatile memory designating a particular set of paper sizes, (extended and standard target sets), and automatically selecting the appropriate copy sheet storage receptacle, including the determination of the amount of acceptable image on copy sheet error. The determination of the amount of acceptable image on copy sheet error includes the step of determining the ratio of image space to non-image space on the copy sheet and the amount of potential image loss on the copy sheet.

For a better understanding of the present invention, reference maybe had to the accompanying drawings wherein the same reference numerals have been applied to like parts and wherein:

IN THE DRAWINGS

FIGS. 6A-6H illustrate a flow chart of the automatic paper size selection technique in accordance with the present invention.

DETAILED DESCRIPTION OF THE INVENTION

Figure 1:
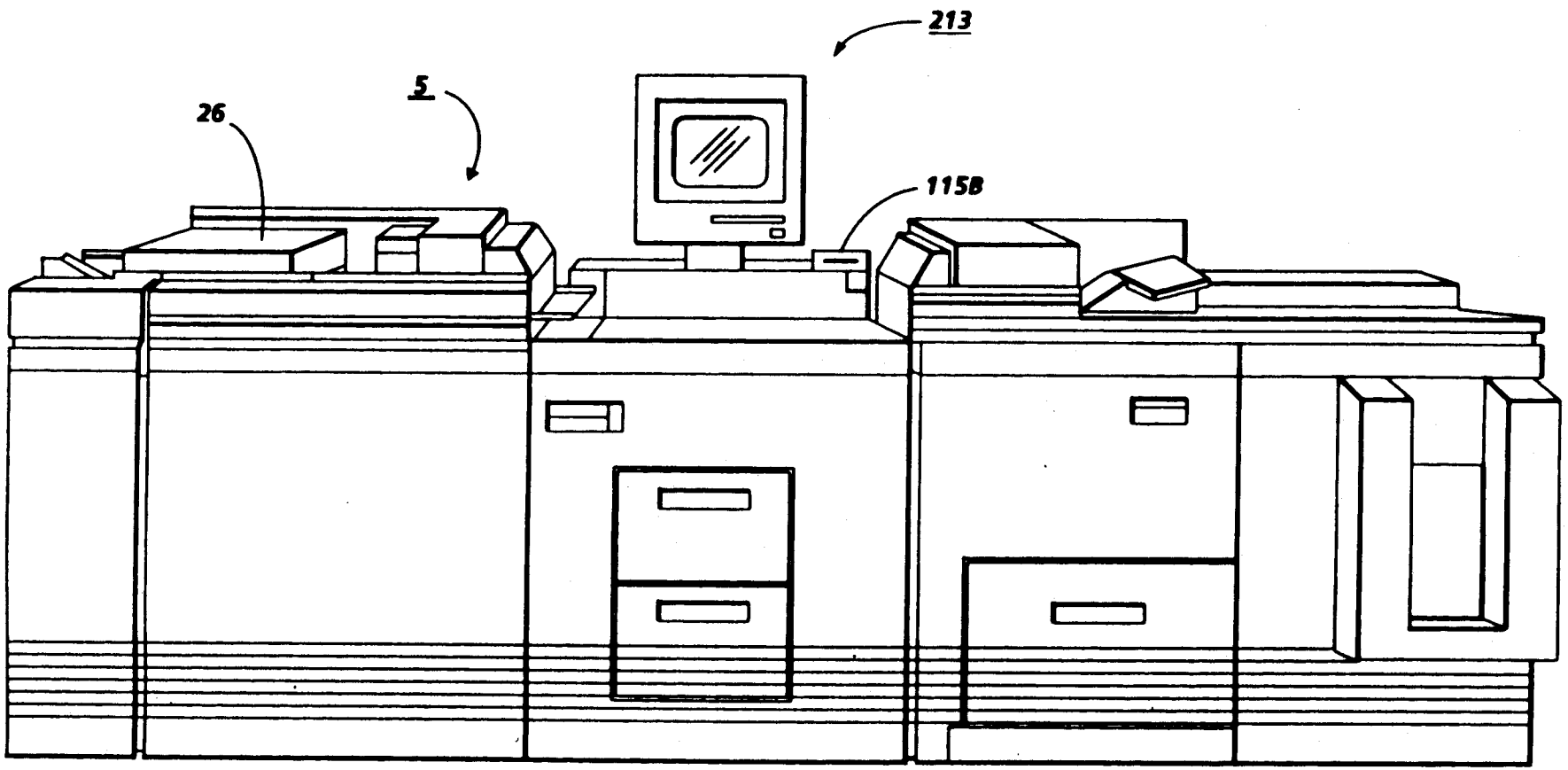
FIG. 1 is an isometric view of an illustrative reproduction machine incorporating the present invention.
Figure 2:
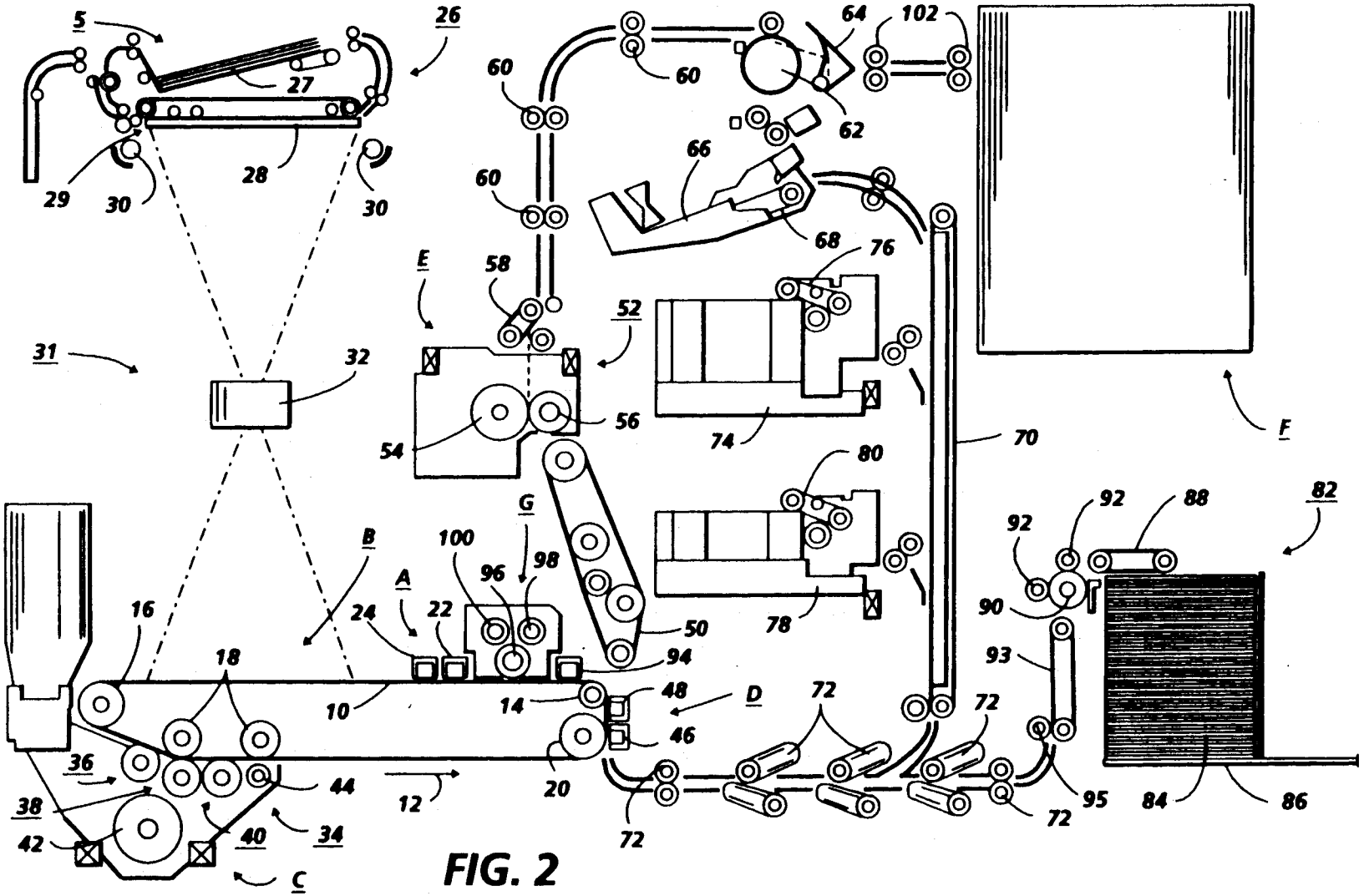
FIG. 2 is a schematic elevational view depicting various operating components and subsystems of the machine shown in FIG. 1.

Referring to FIGS. 1 and 2, there is shown an electrophotographic reproduction machine 5 composed of a plurality of programmable components and subsystems which cooperate to carry out the copying or printing job programmed through a touch dialogue User Interface (U.I.). Machine 5 is typical of the machine incorporating the present invention and employs a photoconductive belt 10. Belt 10 is entrained about stripping roller 14, tensioning roller 16, idler rollers 18, and drive roller 20. Drive roller 20 is rotated by a motor coupled thereto by suitable means such as a belt drive. As roller 20 rotates, it advances belt 10 in the direction of arrow 12 through the various processing stations disposed about the path of movement thereof.

Initially, the photoconductive surface of belt 10 passes through charging station A where two corona generating devices, indicated generally by the reference numerals 22 and 24 charge photoconductive belt 10 to a relatively high, substantially uniform potential. Next, the charged photoconductive belt is advanced through imaging station B. At imaging station B, a document handling unit 26 sequentially feeds documents from a stack of documents 27 in a document stacking and holding tray into registered position on platen 28. A pair of Xenon flash lamps 30 mounted in the optics cavity shown generally at 31 illuminate the document on platen 28, the light rays reflected from the document being focused by lens 32 onto belt 10 to expose and record an electrostatic latent image on photoconductive belt 10 which corresponds to the informational areas contained within the document currently on platen 28. After imaging, the document is returned to the document tray via a simplex path when either a simplex copy or the first pass of a duplex copy is being made or via a duplex path when a duplex copy is being made.

The electrostatic latent image recorded on photoconductive belt 10 is developed at development station C by a magnetic brush developer unit 34 having three developer rolls 36, 38 and 40. A paddle wheel 42 picks up developer material and delivers it to the developer rolls 36, 38. Developer roll 40 is a cleanup roll while a magnetic roll 44 is provided to remove any carrier granules adhering to belt 10.

Following development, the developed image is transferred at transfer station D to a copy sheet. There, the photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detach the copy sheet from belt 10.

Following transfer, a conveyor 50 advances the copy sheet bearing the transferred image to fusing station E where a fuser assembly, indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to gate 64 which guides the sheet to either finishing station F via rolls 102 or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70 and rollers 72 for transfer of the second toner powder image to the opposed sides of the copy sheets. The duplex sheet is then fed through the same path as the simplex sheet to be advanced to finishing station F.

Copy sheets are supplied from a secondary tray 74 by sheet feeder 76 or from the auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93, which in cooperation with idler roll 95 and rolls 72, move the sheet to transfer station station D.

After transfer station D, photoconductive belt 10 passes beneath corona generating device 94 which charges any residual toner particles remaining on belt 10 to the proper polarity. Thereafter, a pre-charge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

The various functions of machine 5 are regulated by a controller which preferably comprises one or more programmable microprocessors. The controller provides a comparison count of the copy sheets, the number of documents being recirculated, the number of copy sheets selected by the operator, time delays, jam corrections, etc. As will appear, programming and operating control over machine 5 is accomplished through a User Interface. Operating and control information, job programming instructions, etc. are stored in a suitable memory which includes both ROM and RAM memory types. Conventional sheet path sensors or switches may be utilized to keep track of the position of the documents and the copy sheets. In addition, the controller regulates the various positions of the gates depending upon the mode of operation selected.

Figure 3:
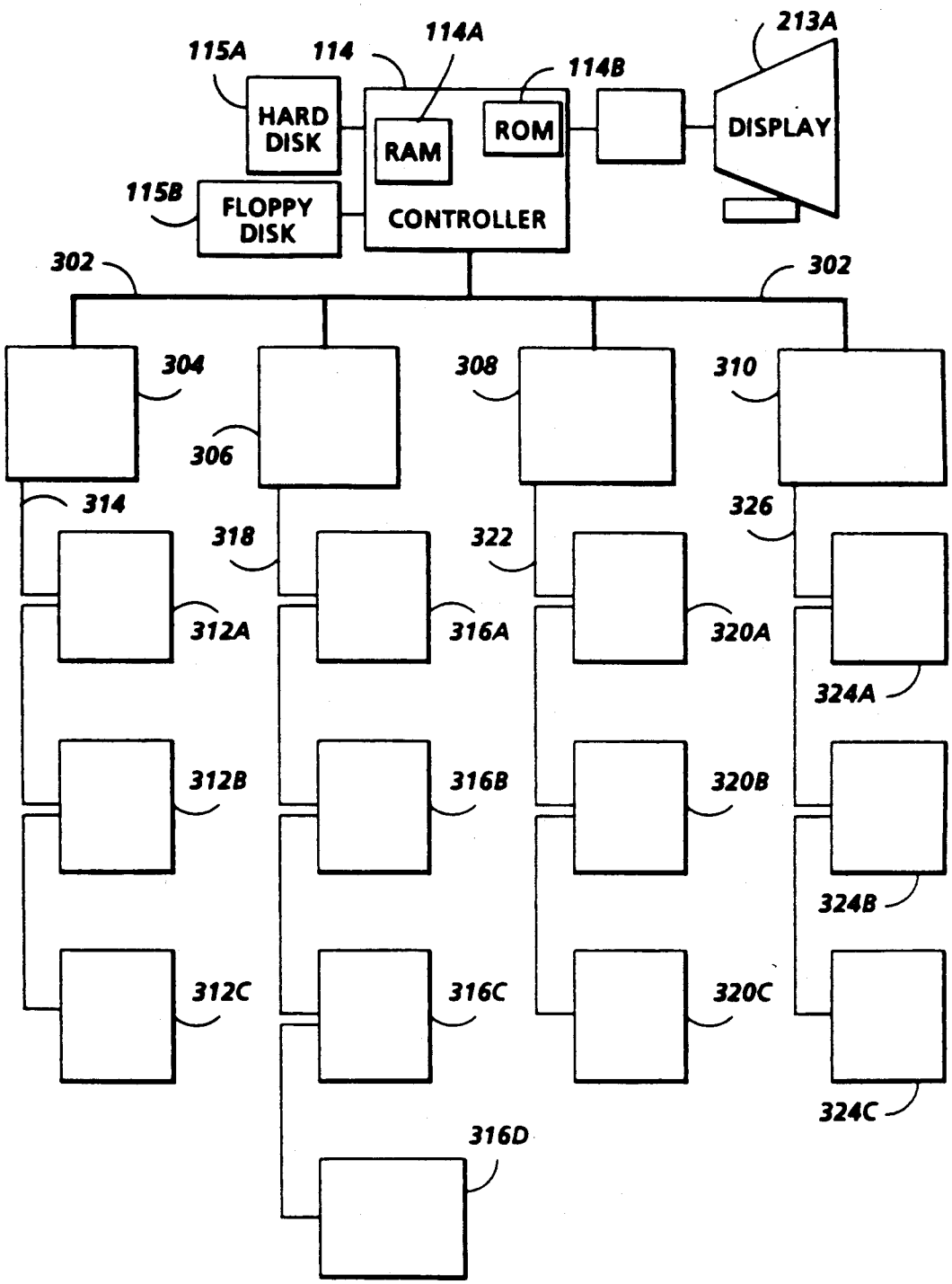
FIG. 3 is a block diagram of the operating control systems and memory for the machine shown in FIG. 1.

With reference to FIG. 3, a memory includes a hard or rigid disk drive 115A and a floppy disk drive 115B connected to Controller 114 including random access memory 114A and read only memory 114B. In a preferred embodiment, the rigid disks are two platter, four head disks with a formatted storage capacity of approximately 20 megabytes. The floppy disks are 3.5 inch, dual sided micro disks with a formatted storage capacity of approximately 720 kilobytes. Preferably, all of the control code and screen display information for the machine is loaded from the rigid disk at machine power up. Changing the data that gets loaded into the machine for execution can be done by exchanging the rigid disk in the machine 5 for another rigid disk with a different version of data or by modifying the contents of the current rigid disk by transferring data from one or more floppy disks onto the rigid disk using the floppy disk drive built into the machine 5. Suitable display 213A of U.I. 213 is also connected to Controller 114 as well as a shared line system bus 302.

The shared line system bus 302 interconnects a plurality of core printed wiring boards including an input station board 304, a marking imaging board 306, a paper handling board 308, and a finisher/binder board 310. Each of the core printed wiring boards is connected to local input/output devices through a local bus. For example, the input station board 304 is connected to digital input/output boards 312A and 312B and servo board 312C via local bus 314. The marking imaging board 306 is connected to analog/digital/analog boards 316A, 316B, digital input/output board 316C, and stepper control board 316D through local bus 318. In a similar manner, the paper handling board 308 connects digital input/output boards 320A, B and C to local bus 322, and finisher/binder board 310 connects digital input/output boards 324A, B and C to local bus 326.

Figure 4:
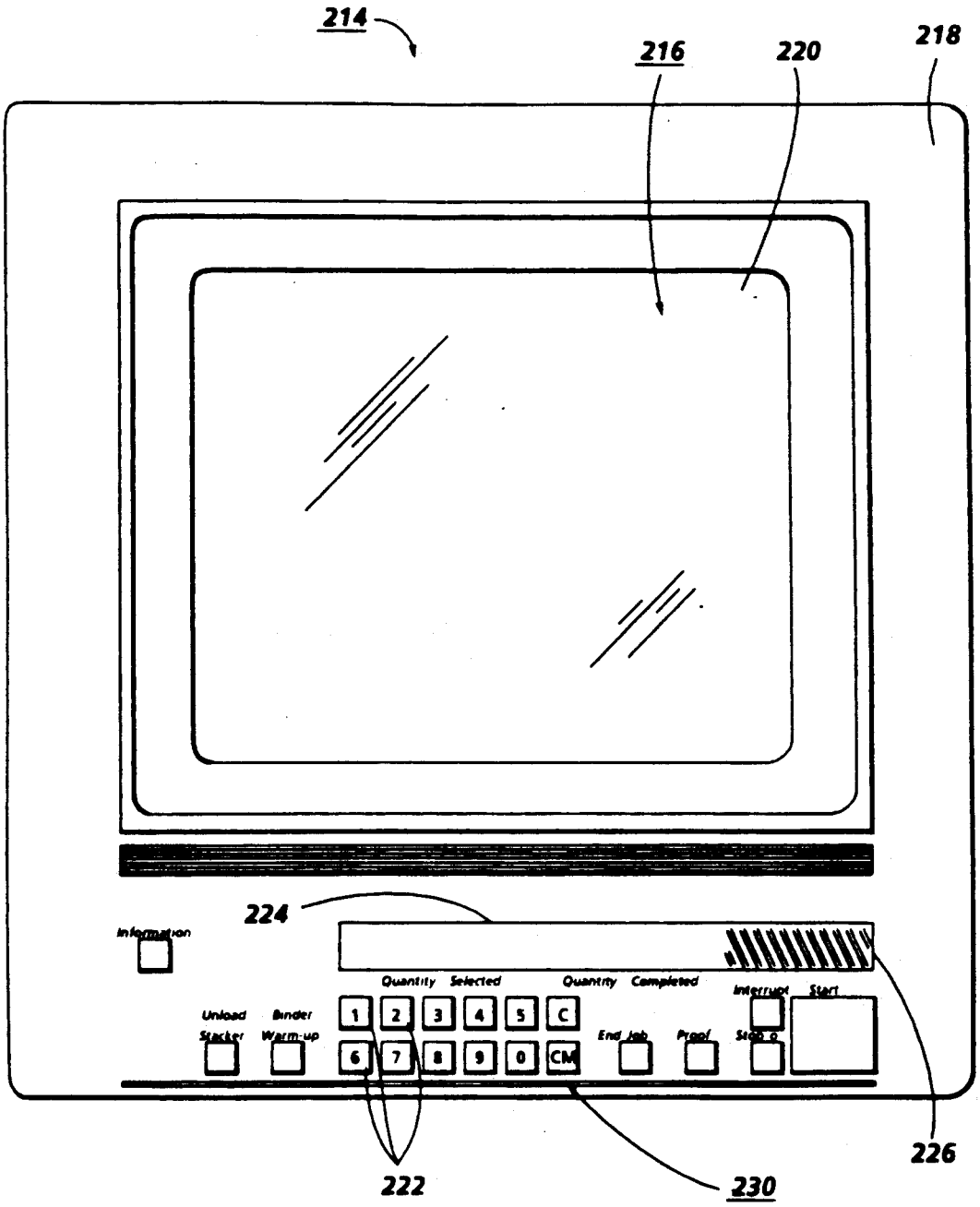
FIG. 4 is a front view of the of the user interface of the machine of FIG. 1.

Referring to FIG. 4, there is shown the touch monitor 214 for the touch dialogue U.I. 213 of the present invention. As will appear, monitor 214 provides an operator user interface with hard and soft touch control buttons enabling communication between operator and machine 10. Monitor 214 comprises a suitable cathode ray tube 216 of desired size and type having a peripheral framework forming a decorative bezel 218 thereabout. Bezel 218 frames a rectangular video display screen 220 on which soft touch buttons in the form of icons or pictograms and messages are diplayed as will appear with a series of hard control buttons 222 and 10 seven segment displays 224 therebelow. Displays 224 provide a display for copy "Quantity Selected", copy "Quantity Completed", and an area 226 for other information.

Hard control buttons 222 comprise "0–9" buttons providing a keypad 230 for programming copy quantity, code numbers, etc., a clear button "C" to reset display 224; a "Start" button to initiate print; a clear memory button "CM" to reset all dialogue mode features to default and place a "1" in the least significant digit of display 224; a "Stop" button to initiate an orderly shutdown of machine 5; an "Interrupt" button to initiate a job interrupt; a "Proof" button to initiate making of a proof copy; and an "i" button to initiate a request for information.

Operator programming of the machine via the U/I is facilitated through display of programming screens or frames on CRT display 220 which represent programming features of the machine. Signals from IR touch sensors are fed to the machine controller where they are interpreted with respect to the current programming screen. Subsequently operator selections are displayed on CRT display 220 and the appropriate machine subsystems are enabled, disabled or adjusted accordingly.

Figure 5:
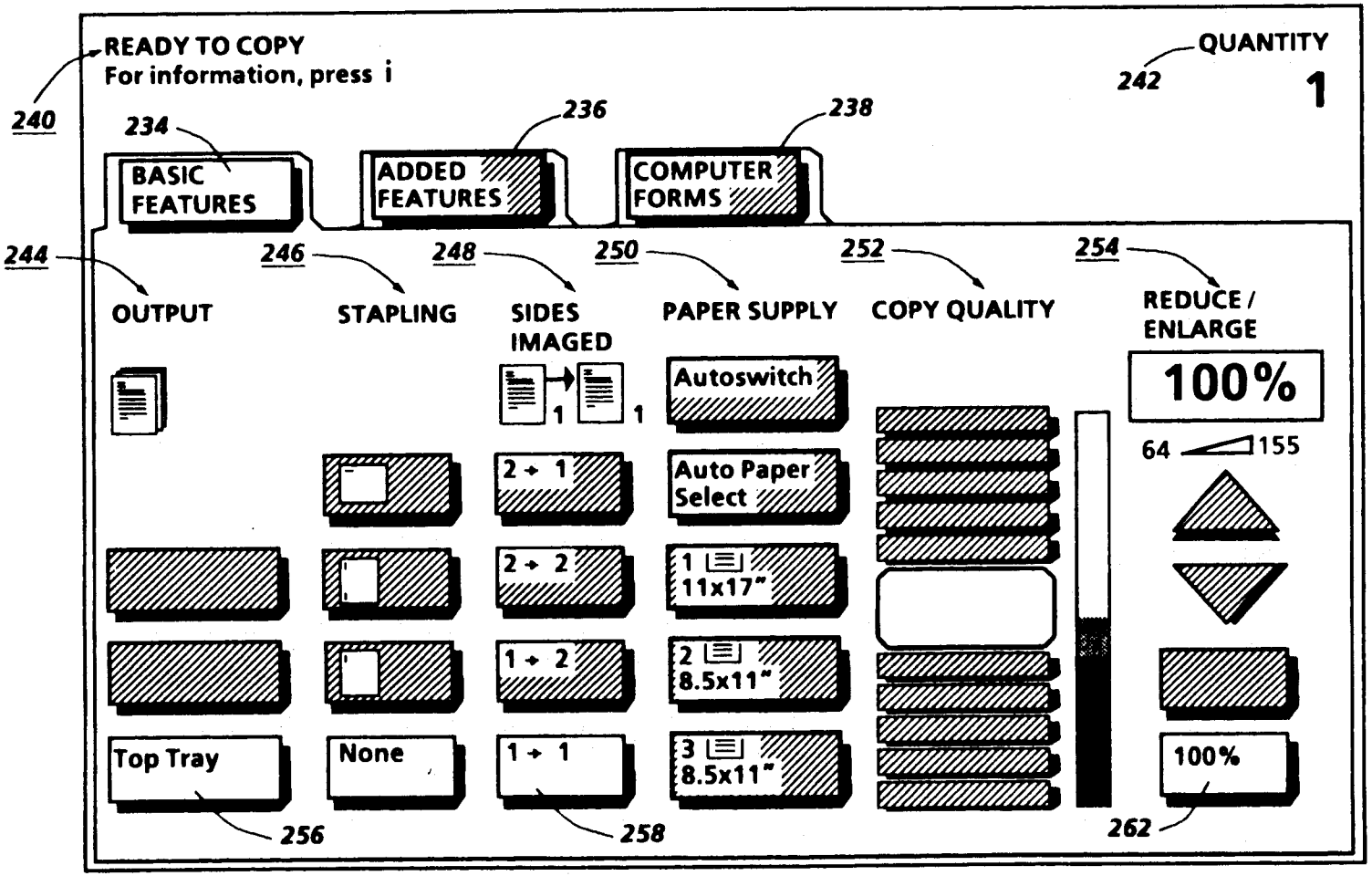
FIG. 5 is a typical initial touch screen display for operator-machine dialogue of the machine of FIG. 1.

Programming screens or frames, as displayed on CRT display 220, are used by the operator to select the feature set appropriate for the completion of a copying job. Specifically, the programming screens consist of a series of a three primary screens, arranged in a file folder or tab format, as illustrated in FIG. 5. In certain instances, selection of specific programming features can only be done to the exclusion of other features due to machine constraints or known undesirable outcomes (e.g. stapling of transparency copy sheets). The currently programmed feature set is always displayed using programming frames, where selected features are indicated as highlighted or white buttons and disabled or deselected features are indicated with a gray background.

With reference to FIG. 5, there is illustrated a typical user interface display or screen providing an operator/-machine dialogue. The screen presents to the operator in the form of tabs, a basic features mode 234, an added features mode 236, and a computer forms mode 238. Also at the top of the display frame are a machine ready indicator 240 and a quantity programmed indicator 242. The three modes typically could be in a gray appearance and upon selection of a particular mode such as the top tray 256 by the operator, the top tray soft button would transform from a gray appearance to a white appearance. There are also illustrated basic programming features available to the operator other than the quantity or number of copies to be produced, such a copy output feature 244, a stapling feature 246, copy sides feature 248, a paper supply feature 250, a copy quality feature 252 and a reduction and enlarge feature 254. These features display to the operator a variety of options available to program the machine. For example, the copy output feature can offer the operator an uncollated mode, a collated mode, or simply a single sheet top tray mode illustrated at 256.

Similarly, various other "soft" buttons are available for the operator to select a particular stapling feature 246 format for the stapling of completed sets or various combinations of simplex or duplex copying, a one-to-one simplex mode 258 being illustrated in FIG. 5 as the option selected by the operator or the paper supply or feature 250 from which copy sheets are desired to be provided from. Similarly there are options to determine copy quality such as lighter or darker and reduction and enlargement from 64% to 155%, FIG. 5 illustrating a particular copy quality selection and also a reduction-/enlargement selection 262 of 100%.i In accordance with the present invention, The APS feature starts with the list of the defined paper sizes that are appropriate to a particular locality as shown in Table 1. In particular, Table 1 illustrates typical standard sizes for localities 1, 2, 3 and 4 throughout the world. Thus, locality #1 has "Special B4 or 8½"×13" paper size and the other localities have 8½"×14", with similar tradeoffs for B5 and "8×10" paper sizes indicated. In addition, the locality #1 machine is programmable to favor either "FX-SB4" or "B4" for its preferred size due to their nearly equal dimensions and the probability that specific FX accounts would favor the use of only one of these two possible sizes for use with the APS function.

TABLE 1

| | Typical "Standard" paper sizes | | | |
|---|---|---|---|---|
| | ITEM | | | |
| | 1 | 2 | 3 | 4 |
| Trays 1 & 2 Standard and Tray 3 Programmable Sizes | B5<br>8½ × 11<br>A4<br>8½ × 13"<br>FX-SB4*<br>B4<br>A3<br>11 × 17 | 202 × 254 m<br>m<br>8½ × 11<br>A4<br>215 × 330 m<br>m<br>8½ × 14"<br>B4<br>A3<br>11 × 17" | 8½ × 10"<br>8½ × 11"<br>A4<br>8½ × 13"<br>8½ × 14"<br>B4<br>A3<br>11 × 17" | 8 × 10"<br>8½ × 11"<br>A4<br>8½ × 13"<br>8½ × 14"<br>B4<br>A3<br>11 × 17" |

Although each localities' initialization of a machine will allow that machine to properly handle the full array of paper sizes shown in the above table, it is not believed that, for instance, a locality #3 system could generally attempt to find B4 paper for a match if B4 is seldom used in the locality #3 market, especially for casual, walk-up service. Thus, the table above represents the "expanded Standard set" locality paper sizes, and the table below, Table 2, represents the default set of "popular Standard paper sizes":

TABLE 2

| | ITEM | | | |
|---|---|---|---|---|
| | 1 | 2 | 3 | 4 |
| Standard sizes | B5<br>A4<br>B4<br>A3 | 203 × 254 mm<br>A4<br>215 × 330 mm<br>8½× 14"<br>A3 | 8½ × 11"<br>8½ × 14"<br>11 × 17" | 8½ × 11"<br>A4<br>8½ × 14"<br>11 × 17" |

Each machine would default to the smaller set of "standard" sizes; however, at the customer's request, a bit can be set in NVM that would use the full set of paper sizes appropriate to that particular location.

Principles of Operation

In general, APS works by taking the size of the Original and modifying it by applying the selected Magnification Ratio to find the resultant image size. In the following description, the term "standard size" pertains to one of the target sizes of paper as defined both by locality setting and by the bit determining whether the expanded or the popular set of Standard paper sizes should be employed.

The original is initially measured by any standard technique, such as an array of platen sensors, sensors detecting lead and tail edge, and adjustable frames. These usually give a fairly accurate measurement of the size of an original. In one embodiment, if the system detects that the size of an original measured by the frames is within 3 mm of a "standard size", the dimensions of the standard size will be substituted for the purposes of determining a target copy paper size. This allows for a practical amount of misregistration or skew in the placement of the original. It should be noted that the tolerance can be modified and the 3 mm is exemplary only. The original size (measured or substituted) that is obtained from this process is then multiplied by the magnification ratio to find the resultant image size.

When an automatic document handler is used, an indirect measurement process is used. Factors such as the number of sensors covered by the original as it passes on to the document glass, as well as the time over a given sensor place the original in a size bracket. In a given embodiment, 21 zones are available to infer "standard" original sizes based upon the locality. The image size is determined by factoring in the magnification ratio. Once the image size is determined, the system then looks for a dimensional match for a "standard" paper size which is the closest match to the calculated image size, not to exceed an "acceptable" image loss of 3 mm (adjustable) for either length or width.

If the image falls within a standard size target range, the system then looks for the availability of that size of copy paper. Depending upon the paper availability, the following actions are taken by the system: if the target size of paper matches what is defined for tray contents for any of the 3 paper trays and the tray is ready to feed (no tray fault conditions exist), the target size of paper is fed.

If, on the other hand, the target size of paper matches what is defined for tray contents for any of the 3 paper trays and the tray is not ready to feed (ie: a fault exists for that tray), the system looks to see if the target size of paper is available in either of the other trays. If it is, and if that tray is ready, the copy paper will be fed. If the target size of copy paper is loaded but the tray(s) is not available, the system will shut down and display a message to correct the fault condition associated with the desired paper tray (i.e.: load paper, clear jam, close tray, etc.) If the target size of copy paper is not one of those defined in the current contents of the paper trays, the system will shut down and display a message requesting that the target size of copy paper be loaded.

Finally, if the image size does not match the length and width (within 3 mm) of any of the "standard" copy paper, the system then looks to see if the full image will fit onto an available copy paper within the current pitch operation of the copier. If one exists, the image will be copied, and the smallest paper that meets the criteria of "no lost image" will be fed. If none exists, the system will shut down and display a message requesting that the operator take any of a number of corrective actions.

If the image size does not match the length and width (within 3 mm) of any of the "standard" copy paper, and if the full image will not fit onto an available copy paper within the current pitch operation of the copier, the system will shut down and ask the operator to push the start button. Once this is done, the system will then operate in the appropriate pitch mode to make the copy.

This pertains only to jobs with automatic document handler positioning originals, since the jobs with manually-placed originals always run in the pitch determined by the widest copy paper loaded in any of the 3 trays. If the machine is configured to support the "press on regardless" feature, designed to provide maximum throughput (via minimizing shutdowns requesting the operator to load specific paper sizes) while guaranteeing no loss of image, the paper tray containing the size nearest the required image size without image loss that is currently ready for operation shall be used to produce the copy desired.

Figure 6A:
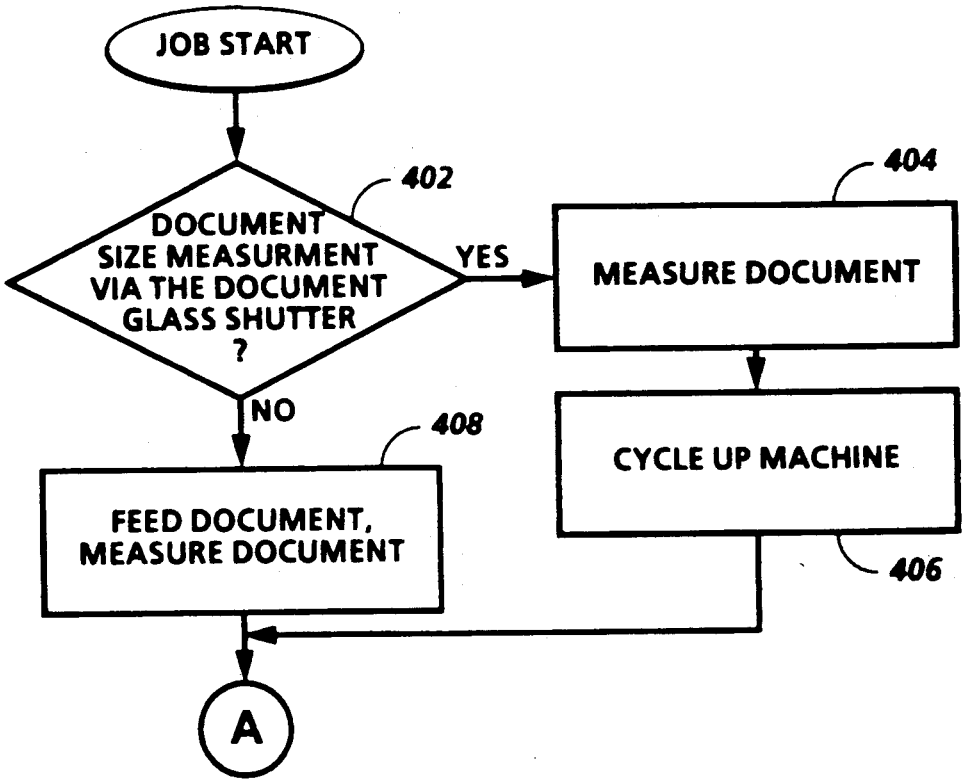

With reference to FIG. 6A, after the job start, there is a determination as to whether or not the document size measurements is via a document glass shutter as shown at block 402. This block basically illustrates a distinction between the measurement of the document size on the platen in a non automatic document handler mode or whether or not the automatic document handler mode is in operation. If yes, the document is measured using the document glass shutter at 404 and the machine is cycled up at 406.

If the document size measurement is not via the document glass shutter, a document is fed from the automatic document handler and the document measured via the automatic document feed mode as shown at 408.

Figure 6B:
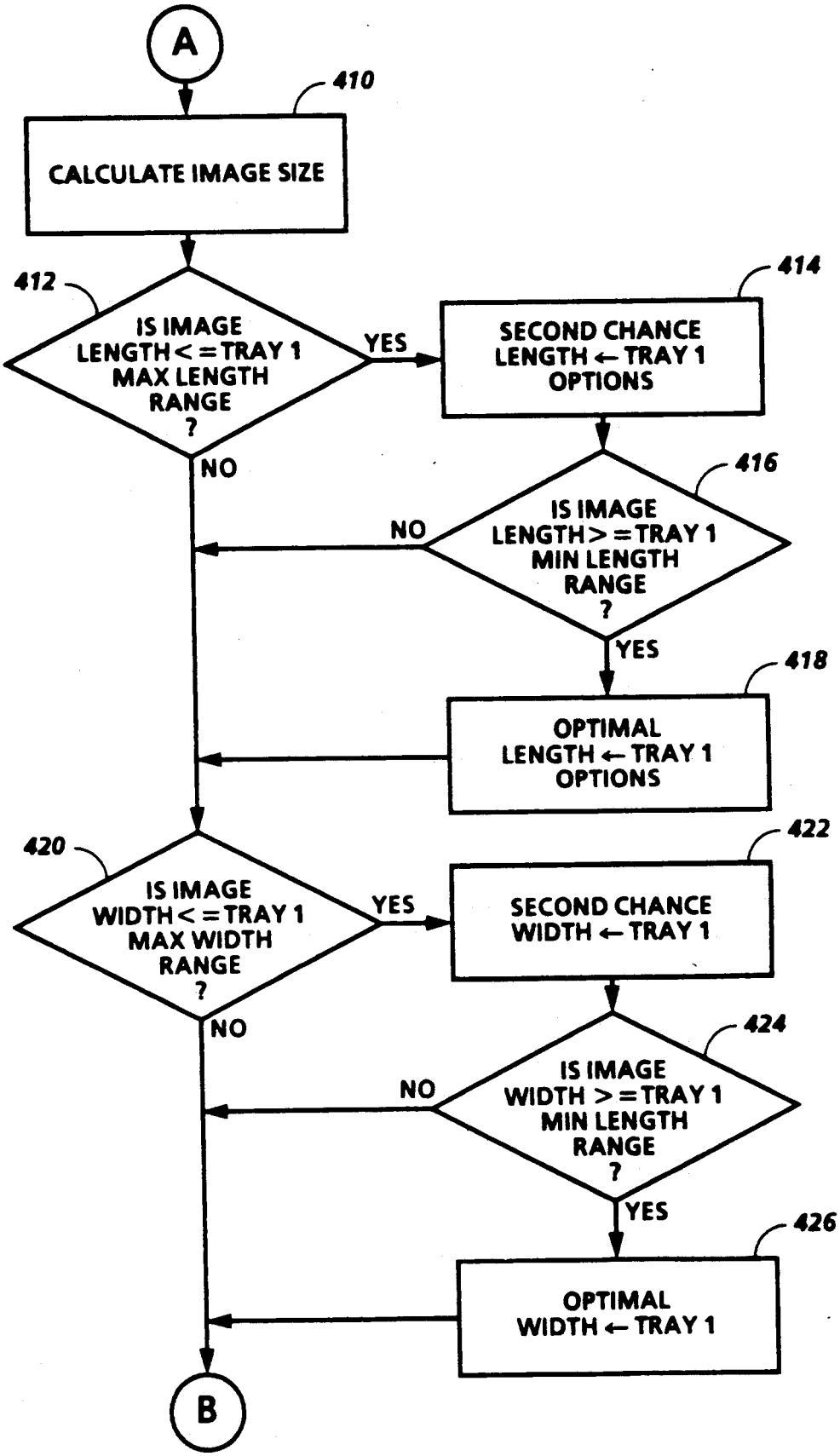

With reference to FIG. 6B, once the size of the document is determined, via the automatic document handler or non automatic document handler mode, the image size is calculated as shown at block 410. This takes into account the length and width of the measured document also taking into account the selected magnification ratio.

At block 412, a determination is made as to whether or not the image length is less than the tray 1 maximum length range. If yes, then the tray 1 copy sheets are potential candidates for the calculated image size as illustrated at block 414. At block 416, the next determination is whether or not the image length is greater than the tray 1 minimum length range. If yes, there is a determination of optimal length at block 418 and a determination of the status of image width is made. In particular, at block 420 there is a determination as to whether or not the image width is less than the tray 1 maximum width range. If yes, then tray 1 is still a potential for correct image size and there is a determination at block 424 as to whether or not the image width is greater than the tray 1 minimum length range. If yes, then there is a determination of optimal width for tray 1 at 426. In any case, once the determination of the likelihood of tray 1 for the proper size copy sheet is made, the system will check trays 2 and 3 in similar manner.

Figure 6C:
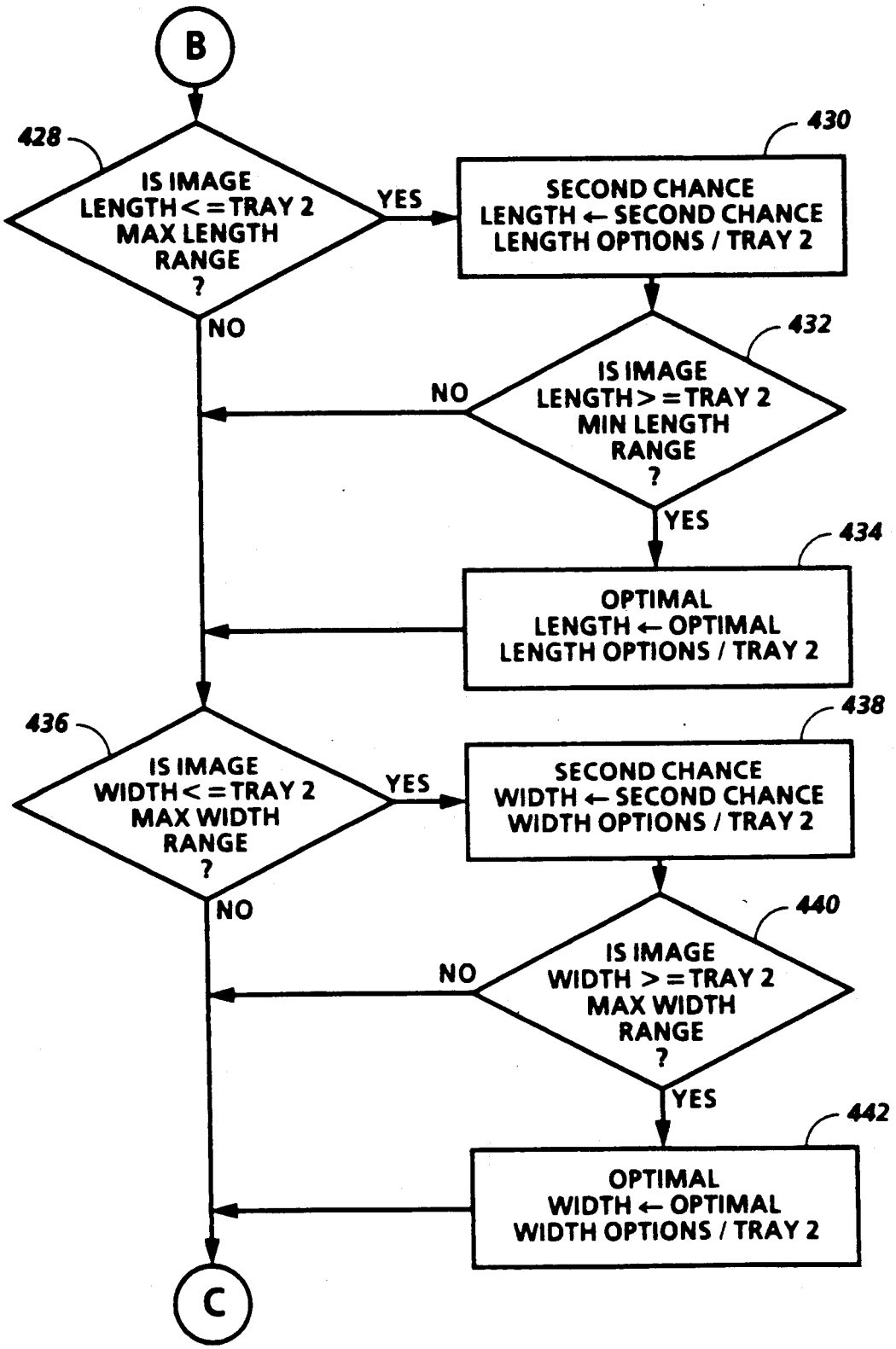

With reference to FIG. 6C, at block 428, similar to block 412, there is a determination if the image length is less than the tray 2 maximum length range. If yes, tray 2 is considered to be a candidate for proper size at 430, a determination of image length being greater than the tray 2 minimum length range is made at 432 and the optimal length determination is made at 434. At block 436 the determination is made whether or not the image width is less than the tray 2 maximum width range. If yes, tray 2 remains a candidate for suitable tray at 438. At block 440, the determination is made whether or not the image width is greater than the tray 2 maximum width range and at 442, the determination is made that the tray 2 is an optimal tray.

Figure 6D:
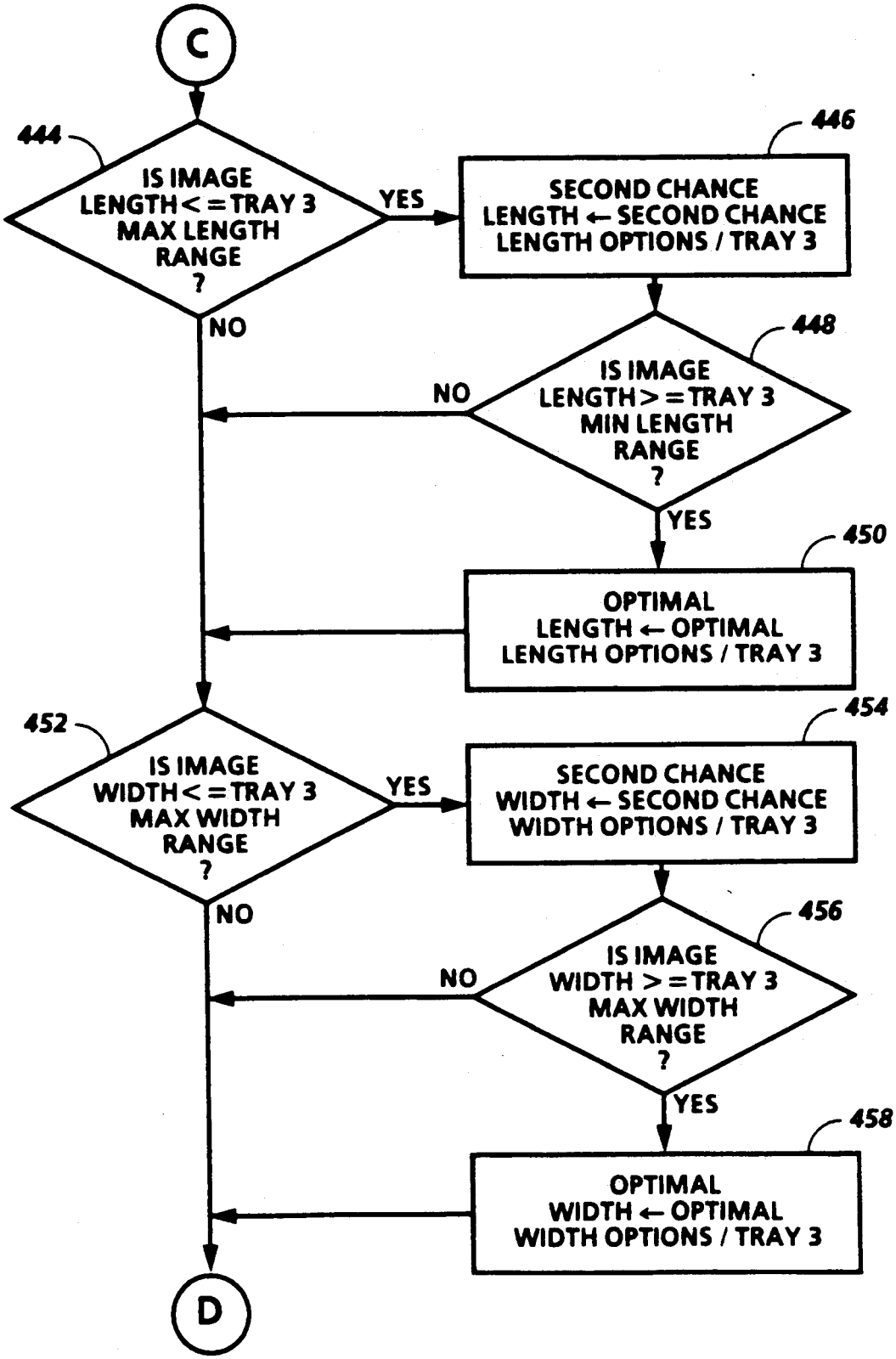

A similar determination is made for tray 3, with reference to FIG. 6D wherein blocks 444 and 452 are similar to blocks 428 and 436 respectively of FIG. 6C, blocks 446, 448 and 450 are similar to blocks 430, 432 and 434, and blocks 454, 456 and 458 are similar to blocks 438, 440, and 442.

Figure 6E:
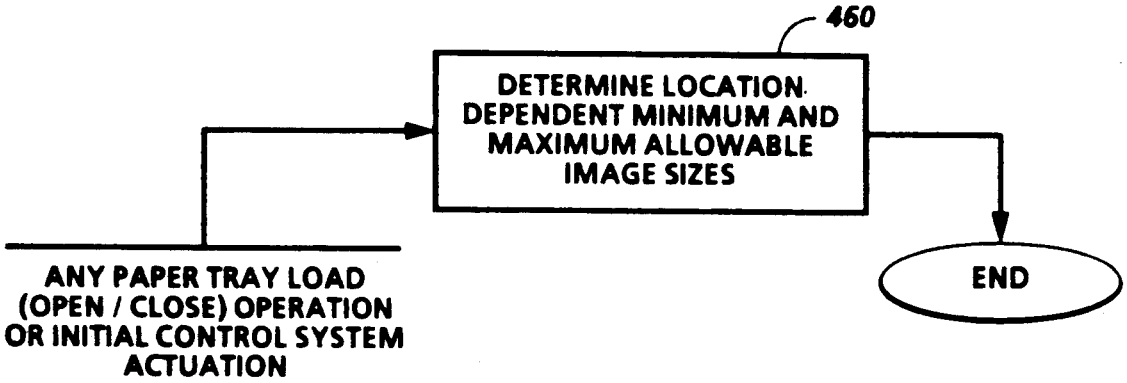

With reference to FIG. 6E, at block 460 there is a determination of a location dependent minimum and maximum allowable image size taking into account any paper tray load operation or initial control system actuation.

Figure 6F:
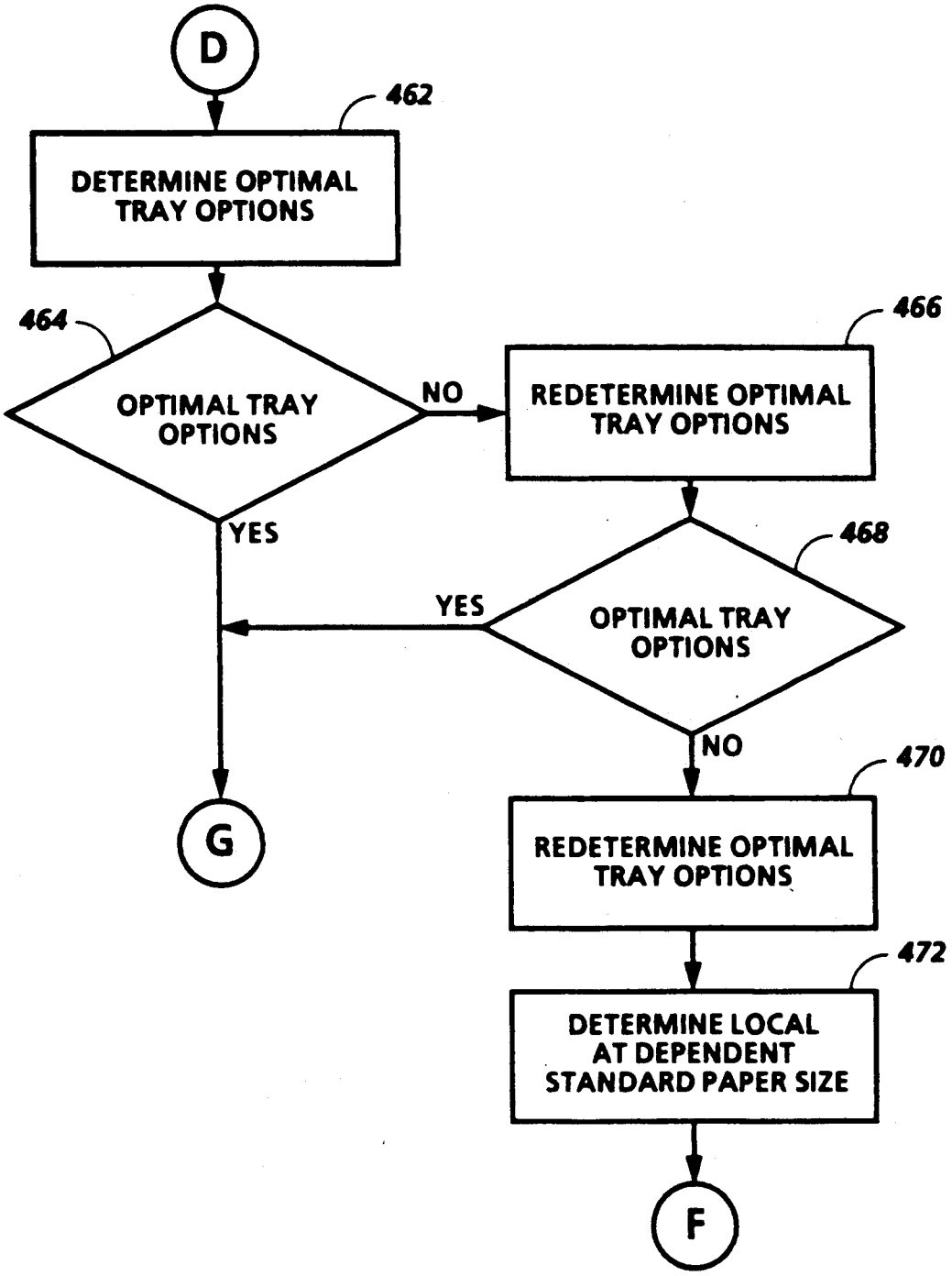

Once the three trays have been analyzed, there is a determination of the optimal tray options as shown at block 462 in FIG. 6F. In short, it is determined at 462 which trays have the correct size copy sheets. It should be noted that although an example of 3 trays have been used throughout, it is well within the scope of the present invention to provide any number of trays holding copy sheets using a similar analysis. At block 464, there is the determination whether or not there is at least one tray with the correct size copy sheets for the calculated image size. This is the determination that there is an optimal copy sheet size in one of the trays to meet the standard requirements of the reproduction operation for the calculated image size. In general, the optimal copy sheet size will fit the full image, but without an undue amount of copy sheet space not occupied by the image. This is a default condition that can be set in accordance with the present invention, for a locality taking into account specific reproduction requirements.

If the preferred or standard requirements are not met by any of the copy sheets in any of the trays, in accordance with the present invention, there is another default stage of acceptable limits that is not preferred but acceptable for the specific reproduction requirement at a specific market or locality. This analysis is preformed as illustrated at block 466 and analyzes such options as an optimal length, but a second width or less than preferred width or an optimal width and a second length or less than preferred length. These conditions are preset and can be altered to a specific requirement or locality.

At block 468, there is a determination as to whether or not one of the trays contains copy sheets that meet the second default or non preferred but still acceptable copy sheet size limitations.

If none of the trays contain copy sheets that meet the second chance width or the second chance length requirements, there is a third default acceptable standard that is determined as illustrated at 470. This is a determination related to the second chance length and the second chance width options. In particular, at block 472, this determination is wholly dependent on the locality or particular market with specific standard paper sizes. At this locality, there is a further lower level acceptability that allows for a slight trimming or non reproduction of a portion of the projected image or permits an unusual amount of blank space on the copy sheet in relation to the accepted image.

With reference to FIG. 6G, there is then generally a determination of which is the correct tray for the acceptable default condition. At block 474 there is a determination if tray 1 contains the location dependent standard size determined at block 478. At blocks 480 and 484 there is a decision to be made relative to trays 2 and 3 respectively, whether or not these trays contains suitable copy sheets as determined at blocks 482 and 486. Block 488 represents this determination, that there is in fact at least one suitable tray. If not, as illustrated at 490, there is a determination of the locality dependent standard paper size that would best fit the projected image size and that block 492 illustrates that a message is delivered on the screen of the operator console that there is a standard paper size fault or deficiency and the machine is cycled down. If there is at least 1 tray available that is suitable copy sheets, a determination is made at block 494 as to which tray has suitable paper and is not in any other default condition as in a jam or in a low paper condition. The correct tray is selected at block 496.

Figure 6H:
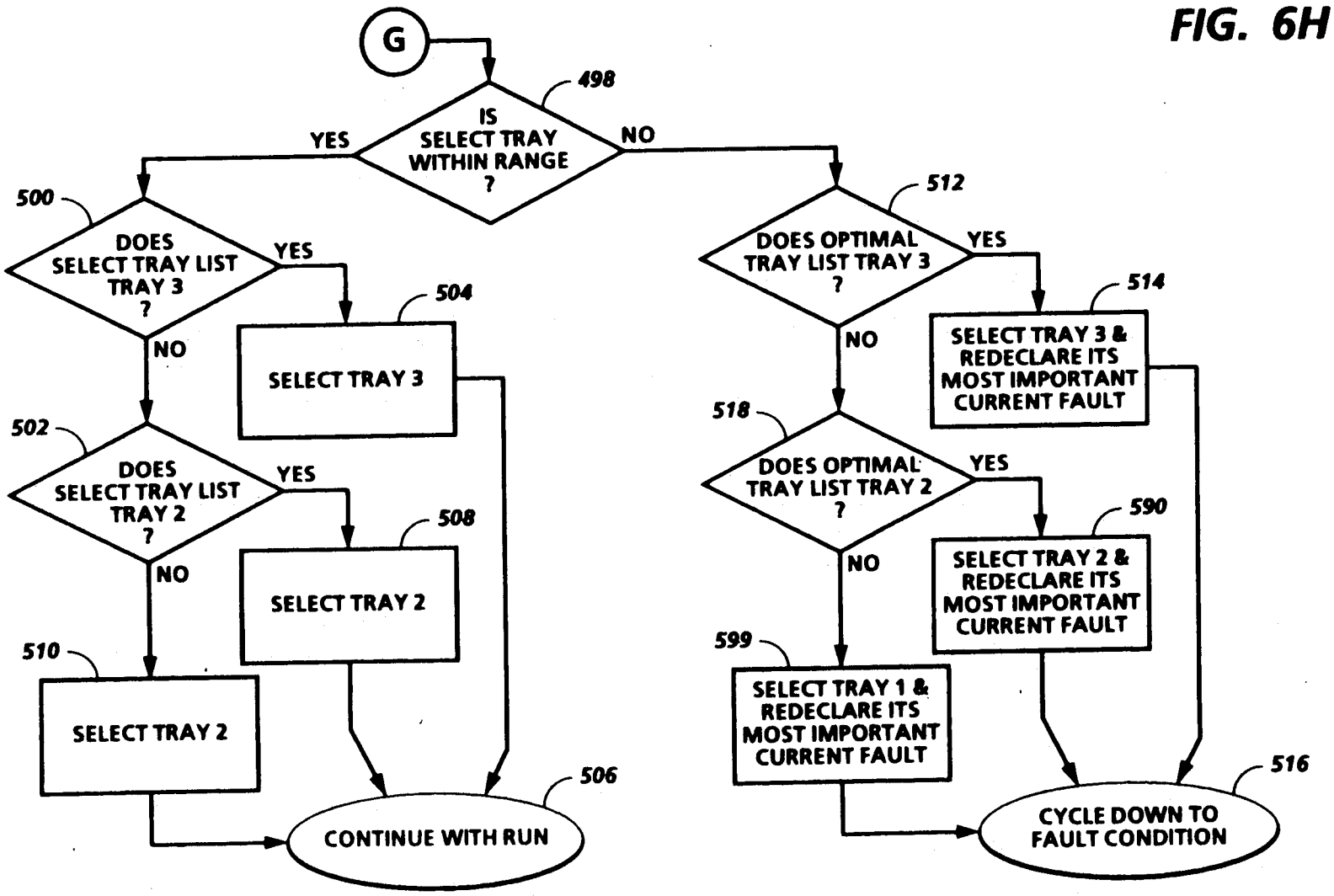

This correct tray determination is made following the sequence as illustrated at FIG. 6H. In particular, at block 498 the control cycles through the analysis based upon whether or not the acceptable size paper trays are ready to feed or are currently in a fault condition. With reference to FIG. 6H, once it is determined that there is a tray within range, again the control cycles through each of the trays to determine which one is acceptable. At block 512, there is a determination as to whether or not the optimal tray list includes tray 3, or tray 2 at block 518 or tray 1 at block 522 with the faults of each of the trays being declared at blocks 522, 520 and 514. If there is a particular tray within range with no faults, whether or not the tray is tray 3 is determined at block 500 and tray 3 selected at block 504. The decision at block 502 is relative to tray 2 which is selected at block 508, and tray 1 selected at block 510. Once a tray has been determined to be suitable, the job run is continued at block 506.

While the invention has been described with reference to the structure disclosed, it is not confined to the details set forth, but is intended to cover such modifications or changes as may come within the scope of the claims attached.

We claim:

1. In a machine with a plurality of operating components for producing images of documents on copy sheets including a sensor to determine document size, a plurality of copy sheet storage receptacles for supplying copy sheets of predetermined sizes, and a control with operator interface, magnification selector, and memory for storing an image to copy sheet fit default condition, the method of automatically selecting a copy sheet storage receptacle comprising the steps of:

sensing the size of the document and the selected magnification ratio, estimating the image size in response to the sensed document size, and the magnification ratio selected, comparing the image size to the predetermined sizes of the copy sheets, determining that the image size is outside the size range of the predetermined sizes of the copy sheets in each of the plurality of copy sheet storage receptacles, relating the image size to the predetermined sizes of the copy sheets by factoring in the relationship the image to copy sheet fit default condition, including the step of tolerating the loss of a given portion of the image on a copy sheet, and selecting a copy sheet storage receptacle in response to the sensed document size, the magnification selected and the image to copy sheet fit default condition.

2. The method of claim 1 wherein the image to copy sheet fit default condition is programmable.

3. The method of claim 1 wherein the step of determining that the image size is outside the size range of the predetermined sizes of the copy sheets in each of the plurality of copy sheet storage receptacles includes the step of determining that the ratio of image size to copy sheet size exceeds a given ratio.

4. The method of claim 1 wherein the step of determining that the image size is outside the size range of the predetermined sizes of the copy sheets in each of the plurality of copy sheet storage receptacles includes the step of determining that the ratio of image size to copy sheet size is less than a given ratio.

5. In a machine with a plurality of operating components for producing images of documents on copy sheets including means to determine document size, a copy sheet storage receptacle for supplying copy sheets of a predetermined size, and a control with memory for storing an image to copy sheet fit default condition and an image to copy sheet worst case fit default condition, the method of operating the machine comprising the steps of sensing the size of the document, determining the image size in response to the sensed document size, comparing the image size to the predetermined size of the copy sheets in the storage receptacle, determining that the image size is outside the size range of the predetermined size of the copy sheets in the storage receptacle, referring to the image to copy sheet fit default condition, determining that the image size is outside the size range of the predetermined size of the copy sheets in the copy sheet storage receptacle with reference to the image to copy sheet fit default condition, referring to the image to copy sheet worst case fit default condition, determining that the image size is within the size range of the predetermined size of the copy sheets in the copy sheet storage receptacle with reference to the image to copy sheet worst case fit default condition, and initiating operation of the machine and advancing copy sheets from the storage receptacle.

6. The method of claim 5 wherein the step of initiating operation of the machine and advancing copy sheets from the storage receptacle includes the step of losing a portion of an image on said copy sheets.

7. In a machine with a plurality of operating components for producing images of documents on copy sheets including means to determine document size, a copy sheet storage receptacle for supplying copy sheets of a predetermined size, and a control with memory for storing a first image to copy sheet default condition and a second image to copy sheets default condition, the second default condition relating to the degree of trimming of the projected image on a copy sheet, the method of operating the machine comprising the steps of determining the size of the document, determining the image size, comparing the image size to the predetermined size of the copy sheets in the storage receptacle with reference to the first image to copy sheet default condition, determining that the image size is outside the size range of the predetermined size of the copy sheets in the copy sheet storage receptacle with reference to the first image to copy sheet default condition, referring to the second image to copy sheet default condition, determining that the image size is within the size range of the predetermined size of the copy sheets in the copy sheet storage receptacle with reference to the second image to copy sheet default condition, and initiating operation of the machine and advancing copy sheets from the storage receptacle.

8. The method of claim 7 wherein the control includes an image magnification selector and the step of determining the image size includes the step of factoring the image magnification selected.

* * * * *